US005518023A

United States Patent [19]

Garcia

[11] Patent Number: 5,518,023

[45] Date of Patent: May 21, 1996

[54] HOSE COILING APPARATUS

[76] Inventor: Derek A. Garcia, 42 Washington St., Middletown, N.Y. 10940

[21] Appl. No.: 396,766

[22] Filed: Mar. 1, 1995

[51] Int. Cl.[6] ..... A62C 35/00

[52] U.S. Cl. ..... 137/355.26; 137/355.23; 242/376.1; 242/393; 242/395

[58] Field of Search ..... 242/376.1, 379.2, 242/379, 393, 395; 137/355.2, 355.23, 355.26, 355.12, 355.16

[56] References Cited

U.S. PATENT DOCUMENTS

| | | | |
|---|---|---|---|
| 1,488,364 | 3/1924 | Snyder | 242/393 |
| 1,675,140 | 6/1924 | Schenderlein | 242/376.1 |
| 2,555,856 | 6/1951 | McElroy et al. | 137/355.17 |
| 2,629,630 | 2/1953 | Roark | 137/355.17 |
| 2,783,089 | 2/1957 | Prout | 137/355.17 |
| 2,823,074 | 2/1958 | Bernard, Jr. | 137/355.17 |

FOREIGN PATENT DOCUMENTS

| | | | |
|---|---|---|---|
| 155627 | 8/1903 | Germany | 242/395 |

*Primary Examiner*—A. Michael Chambers
*Attorney, Agent, or Firm*—Michael I. Kroll

[57] ABSTRACT

A hose coiling apparatus for an acetylene tank having a regulator, a hose and an operating handle. The apparatus comprises a structure for safely storing the hose in a wound up manner. A facility is for mounting the storing structure onto the acetylene tank. A person can grip the operating handle and pull the hose out of the storing structure for use, thereby preventing the hose from getting tangled, pinched and pulled accidentally.

2 Claims, 3 Drawing Sheets

HOSE COILING APPARATUS

BACKGROUND OF THE INVENTION

1. Field of the Invention

The instant invention relates generally to welding equipment and more specifically it relates to a hose coiling apparatus for an acetylene tank.

2. Description of the Prior Art

Numerous welding equipment have been provided in prior art that are adapted to include acetylene tanks with regulators having dangerously dangling hoses, which can get tangled, pinched and pulled. While these units may be suitable for the particular purpose to which they address, they would not be as suitable for the purposes of the present invention as heretofore described.

SUMMARY OF THE INVENTION

A primary object of the present invention is to provide a hose coiling apparatus that will overcome the shortcomings of the prior art devices.

Another object is to provide a hose coiling apparatus for an acetylene tank, with a regulator that will safely store in a wound up manner the hose, so that the hose will not get tangled, pinched and pulled accidentally.

An additional object is to provide a hose coiling apparatus, that includes a rotate spool for storing the hose which is secured in a convenient location onto the acetylene tank to be used therefrom.

A further object is to provide a hose coiling apparatus that is simple and easy to use.

A still further object is to provide a hose coiling apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
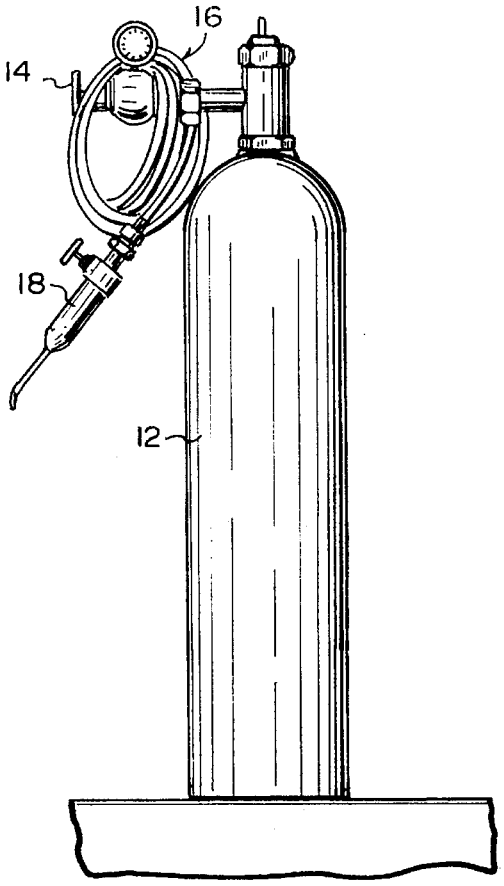
Fig. 1 (PRIOR ART)
FIG. 1 is an elevational view of the prior art, showing the hose wrapped around the regulator.
Figure 2:
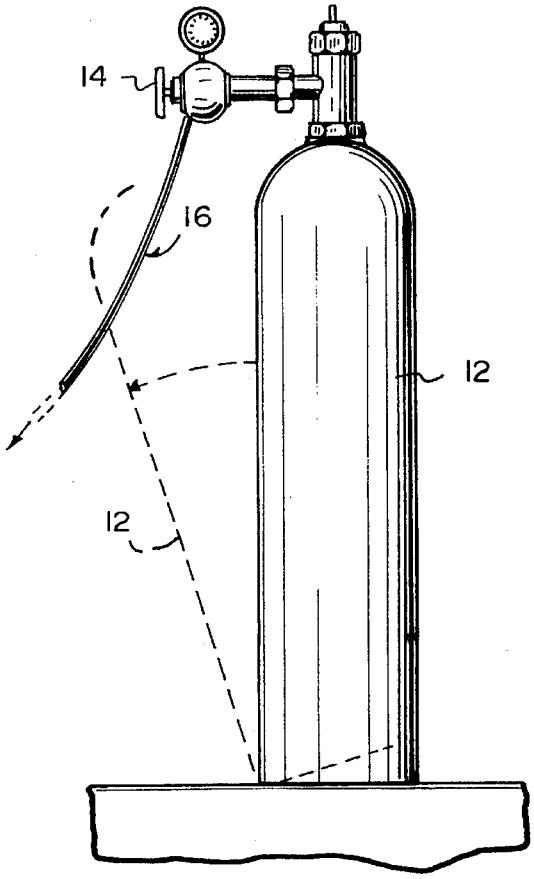
Fig. 2 (PRIOR ART)
FIG. 2 is an elevational view of the prior art, showing the hose being pulled, which will tip over the acetylene tank.
Figure 3:
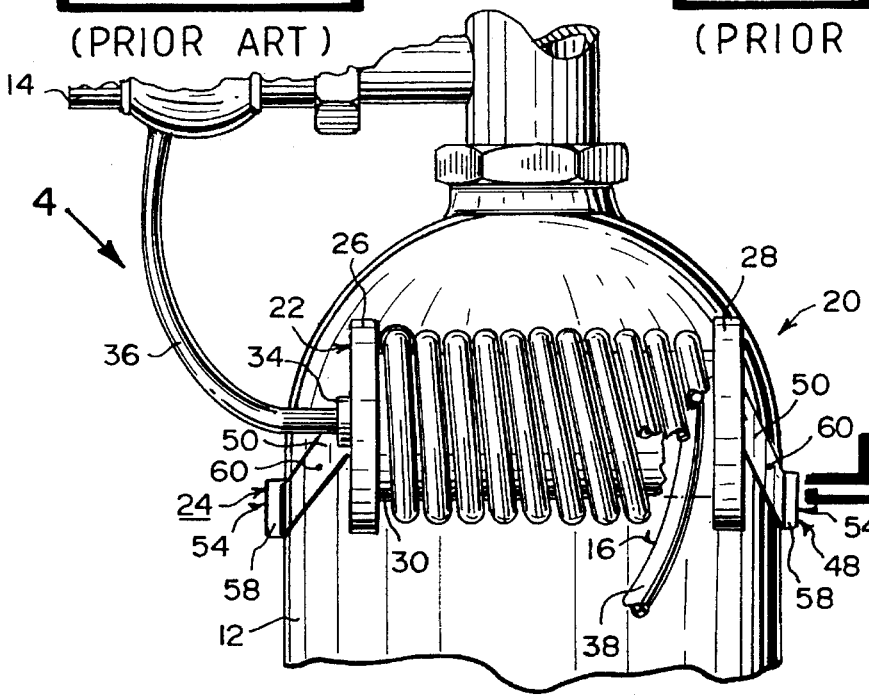
FIG. 3 is an elevational view with parts broken away of an acetylene tank with the instant invention installed thereto.
Figure 4:
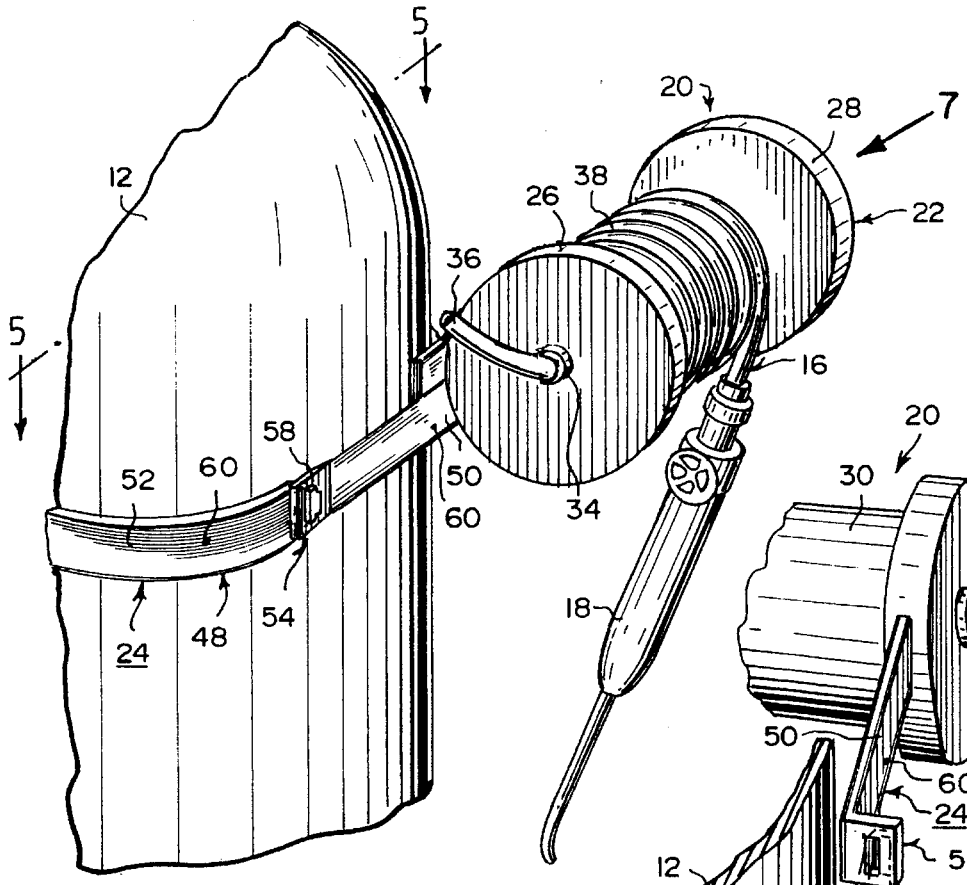
FIG. 4 is a perspective view taken in the direction of arrow 4 in FIG. 3.
Figure 6:
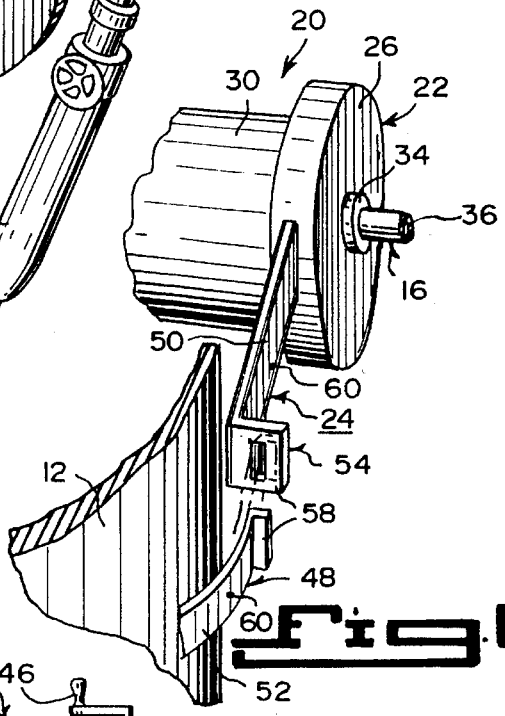
FIG. 6 is a perspective view partly exploded, taken in the direction of arrow 6 in FIG. 5.
Figure 5:
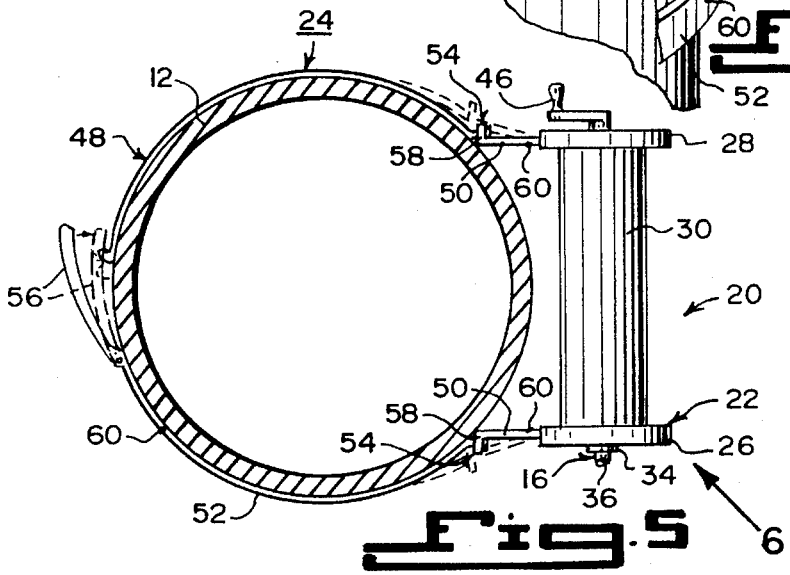
FIG. 5 is a cross sectional view taken along line 5—5 in FIG. 4.
Figure 7:
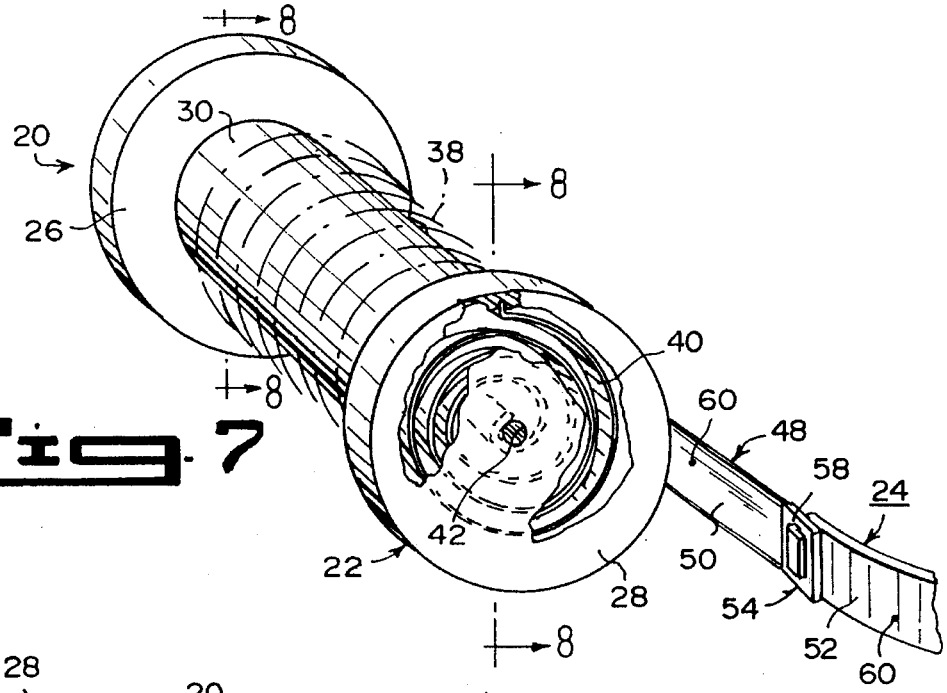
FIG. 7 is a perspective view with parts broken away of the instant invention per se, taken in the direction of arrow 7 in FIG. 4.
Figure 8:
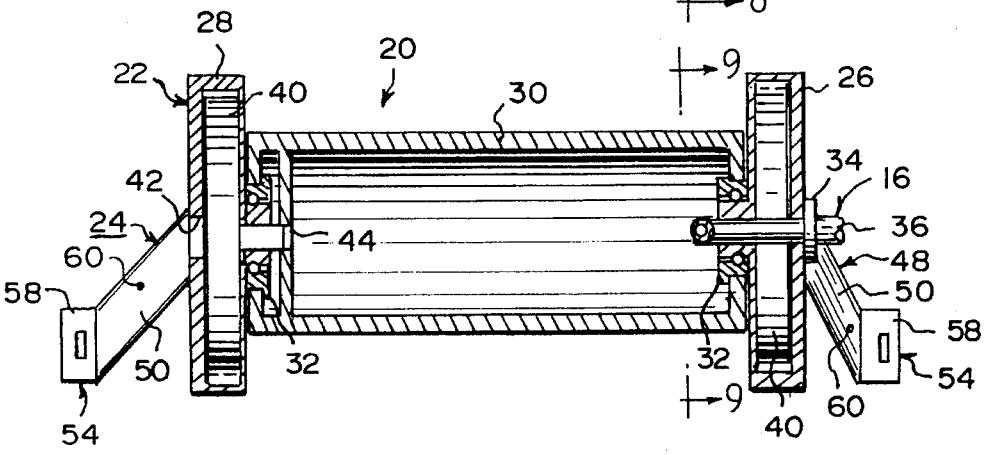
FIG. 8 is a cross sectional view taken along lines 8—8 in FIG. 7.
Figure 9:
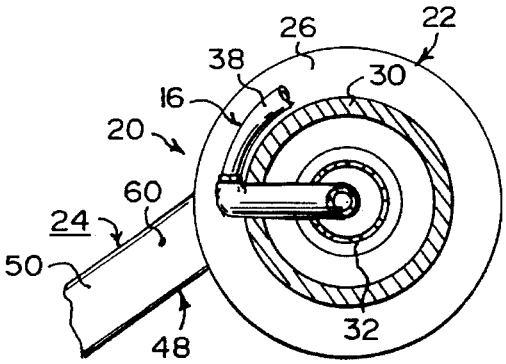
FIG. 9 is a cross sectional view taken along line 9—9 in FIG. 8.

Turning now descriptively to the drawings, in which similar reference characters denote similar elements throughout the several views, FIGS. 1 and 2 shows the prior art, which is an acetylene tank 12, having a regulator 14, a hose 16 and an operating handle 18. The hose 16 in FIG. 1, is coiled about the regulator 14. In FIG. 2, the hose 16 is being pulled accidentally and tipping over the acetylene tank 12.

FIGS. 3 through 10 illustrate the instant invention being a hose coiling apparatus 20 for the acetylene tank 12, having the regulator 14, the hose 16 and the operating handle 18. The apparatus 20 comprises a structure 22, for safely storing the hose 16 in a wound up manner. A facility 24 is for mounting the storing structure 22 onto the acetylene tank 12. A person can grip the operating handle 18 and pull the hose 16 out of the storing structure 22 for use, thereby preventing the hose 16 from getting tangled, pinched and pulled accidentally.

The storing structure 22 includes a pair of stationary members 26, 28. A rotatable spool 30 is between the stationary members 26, 28, so that the hose 16 can be wound up upon the rotatable spool 30. The storing structure 22 further includes a pair of ball bearings 32. Each ball bearing 32 is located between one stationary member 26, 28 and end of the rotatable spool 30.

The swivel connector 34 is centrally located on the first stationary member 26, so as to fluidly attach a short piece 36 of the hose 16 extending from the regulator 14 to a long piece 38 of the hose 16 wrapped about the rotatable spool 30. A pair of rewind coil springs 40 are also provided. Each rewind coil spring 40 is located in one stationary member 26, 28 and is connected between the stationary member 26, 28 and the rotatable spool 30. When the long piece 38 of the hose 16 is pulled off of the rotatable spool 30, it can be automatically rewound upon the rotatable spool 30, when the operating handle 18 is released.

The second stationary member 28 opposite from the first stationary member 26 with the swivel connector 34 has a central aperture 42 therethrough. The rotatable spool 30 has an internal socket 44 adjacent the second stationary member 28. A crank handle 46 fits through the central aperture 42 in the second stationary member 28 and into the internal socket 44. A person can manually rewind the rotatable spool 30 with the crank handle 46.

The mounting facility 24 is a belt assembly 48, which extends from the stationary members 26, 28 and about the acetylene tank 12. The belt assembly 48 consists of a pair of arms 50. Each arm 50 is attached to one stationary member 26, 28 and extends rearwardly and downwardly at an angle therefrom. A strap 52 extends about the acetylene tank 12. Equipment 54 is for attaching the ends of the strap 52 to the ends of the arms 50.

The strap 52 includes a clamp fastener 56, to secure the strap 52 in a tight manner about the acetylene tank 12. The attaching equipment 54 includes a pair of release buckles 58, which hold the ends of the arms 50 to the ends of the strap 52. Each arm 50 is fabricated out of a durable flexible material 60. Each strap 52 is fabricated out of the durable flexible material 60.

Figure 10:
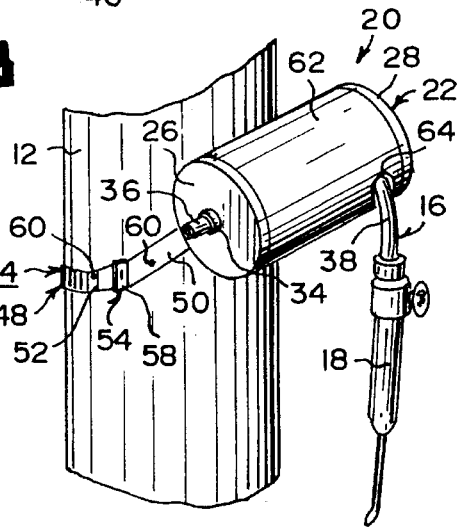
FIG. 10 is a perspective view similar to FIG. 4, showing the instant invention with a cover over the wound up hose on the rotatable spool.

The storing structure 22 further includes each stationary member 26, 28 being disk shaped. A cylindrical cover 62, as shown in FIG. 10, extends between the stationary members 26, 28 over the rotatable spool 30. The cylindrical cover 62 has a hole 64 therethrough to allow the long piece 38 of the hose 16 wrapped upon the rotatable spool 30 to exit through the cylindrical cover 62, when the operating handle 18 is pulled.

LIST OF REFERENCE NUMBERS

12 acetylene tank
14 regulator
16 hose
18 operating handle
20 hose coiling apparatus 20
22 storing structure
24 mounting facility
26 first stationary member of 22
28 second stationary member of 22
30 rotatable spool of 22
32 ball bearing of 22
34 swivel connector on 26
36 short piece of 16
38 long piece of 16
40 rewind coil spring in 26, 28
42 central aperture in 28
44 internal socket in 30
46 crank handle
48 belt assembly for 24
50 arm of 48
52 strap of 48
54 attaching equipment of 48
56 clamp fastener on 52
58 release buckle of 54
60 durable flexible material for 50
62 cylindrical cover
64 hole in 62

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A hose coiling apparatus for an acetylene tank having a regulator, a hose and an operating handle located at the top of said tank, said apparatus comprising:

a) means for safely storing the hose in a wound up manner mounted on the side of said tank near the top thereof adjacent said regulator;

b) said mounting means comprising a readily removable belt assembly surrounding said tank and a pair of spaced, arms extending downwardly and outwardly from said belt assembly, said belt assembly including a strap extending about said tank, means comprising release buckles for attaching, the ends of said strap to said arms, and releasable clamp fastener means for securing said strap about said tank; and c) said storing means comprising a pair of first and second stationary members attached to said arms, a rotatable spool extending between said stationary members on which said hose is wound, a pair of ball bearings in which each said ball bearing is located between one said stationary member and an end of said rotatable spool, swivel connector means centrally located on said first stationary member for fluidly connecting a short piece of hose extending from said regulator to the end of the hose wrapped about said rotatable spool, rewind spring means located in each said stationary means connected between said stationary member and said rotatable spool so that when the hose on said rotatable spool is pulled off said spool said spring means gets wound up and will automatically rewind the hose on said spool when said operating handle is released, a central aperture formed in said second stationary member, an internal socket adjacent said second stationary member and crank handle means passing through said central aperture and terminating in said internal socket for manually rewinding said rotatable spool.

2. A hose coiling apparatus as recited in claim 1, wherein said storing means further includes:

a) each said stationary member being disk shaped; and b) a cylindrical cover extending between said stationary members over said rotatable spool, said cylindrical cover having a hole therethrough to allow the long piece of the hose wrapped upon the rotatable spool to exit through said cylindrical cover, when the operating handle is pulled.

* * * * *